US006234385B1

(12) United States Patent
Espinoza et al.

(10) Patent No.: US 6,234,385 B1
(45) Date of Patent: May 22, 2001

(54) SIDE LOADING STORAGE BOX

(75) Inventors: Alfred D. Espinoza, La Habra; Robert R. Foreman; Emily M. Okasaki, both of Stockton, all of CA (US)

(73) Assignee: R.R. Foreman and Company, Stockton, CA (US)

( * ) Notice: Subject to any disclaimer, the term of this patent is extended or adjusted under 35 U.S.C. 154(b) by 0 days.

(21) Appl. No.: 09/389,780

(22) Filed: Sep. 3, 1999

(51) Int. Cl.[7] ..... B65D 5/42

(52) U.S. Cl. ..... 229/122; 229/122; 229/149; 229/915; 493/56; 493/70; 493/80

(58) Field of Search ..... 229/122, 149, 229/150, 915; 206/425; 493/56, 69–72, 73, 79–81

(56) References Cited

U.S. PATENT DOCUMENTS

| | | | | |
|---|---|---|---|---|
| 264,383 | | 9/1882 | Weiner . | |
| D. 372,673 | | 8/1996 | Turner . | |
| 457,390 | | 8/1891 | Weeks . | |
| 2,162,089 | * | 6/1939 | Kagen | 229/122 |
| 2,180,691 | | 11/1939 | Olivier . | |
| 2,591,593 | | 4/1952 | Nolan . | |
| 2,663,485 | * | 12/1953 | Johnson | 229/149 |
| 2,788,827 | | 4/1957 | Banner | 150/52 |
| 3,050,228 | * | 8/1962 | Lane | 229/122 |
| 3,370,775 | * | 2/1968 | Link | 229/122 |
| 3,398,000 | | 8/1968 | Peters . | |
| 3,441,193 | | 4/1969 | Castle . | |
| 3,552,579 | * | 1/1971 | Simon et al. | 229/915 |
| 3,858,720 | | 1/1975 | Flagler | 206/216 |
| 4,142,566 | | 3/1979 | Stolp | 150/52 J |
| 4,353,495 | * | 10/1982 | Jes | 229/122 |
| 4,436,243 | | 3/1984 | Nason et al. . | |
| 4,550,853 | | 11/1985 | Grati . | |
| 4,817,861 | * | 4/1989 | Henrikson | 229/122 |
| 4,955,925 | | 9/1990 | Platti | 15/257.6 |
| 5,259,631 | | 11/1993 | Brande | 229/121 |
| 5,813,597 | * | 9/1998 | Wakevainen | 229/122 |

OTHER PUBLICATIONS

Brochure for Perma–Stor Computer Printout Binder File.
Brochure for Fellows Bankers Box.
Brochure for ACCO Transfer Drawers.

* cited by examiner

*Primary Examiner*—Gary E. Elkins
(74) *Attorney, Agent, or Firm*—Joshua D. Isenberg

(57) ABSTRACT

A single-piece side-loading box having triple side-wall construction and a unique latching tab. The box incorporates walls, a floor, a top, a side-opening panel and latching tab in one unitary piece. The one piece box generally includes a bottom panel, front, side and back panels attached to the bottom panel and a lid attached to the back panel. A latching tab with integral handle is incorporated into the front panel. The box is preferably assembled from a cutout made from a single piece of material. The side-walls, side wings and side reinforcements fold into each other to provide a triple-side-wall construction that allows the box to support a great weight.

19 Claims, 7 Drawing Sheets

SIDE LOADING STORAGE BOX

BACKGROUND OF THE INVENTION

A conventional storage container top-loading box has one or more vertical sides and a bottom formed into an enclosure with an opening at the top. The container is typically fitted with a lid configured to close the opening at the top. The lid may be hinged to the top of one or more of the vertical sides. Alternatively the lid may be a separate removable piece. Often the container is provided with dividers or inserts that divide up the interior of the box into separate compartments for protection and organization of the articles stored in the container. Although such containers have been used from time immemorial to store articles, they suffer drawbacks. Most notably, if, as is often the case, it is desirable to stack a plurality of such containers for storage, the containers must be un-stacked to gain access to the contents of the containers below the top of the stack. To overcome this, side-loading containers have been developed.

Side-loading boxes have been known in the art of box making for over 100 years. The basic construction of such a side-loading box is similar to that of the more conventional top-loading box laid upon one of its vertical sides such that the opening is at the side rather than the top. However, slightly different construction is necessary for the side opening box in order to provide satisfactory means of closing the open side.

One solution simply provides a conventional top-loading box with one side that folds down. The folding side is often secured in place by a conventional lid. Although side-loading boxes of this type provide satisfactory loading, they suffer from drawbacks. First, the folding side panel weakens the structure of the box limiting the maximum load that can be stored before the box begins to bulge. Second, the weakening of the box limits the maximum height to which such boxes can be stacked. Third, if the lid is of the conventional type, it must be either displaced or removed in order to open the side panel. If the lid is integrally incorporated into the top of the box, it is often necessary to open the box by wedging the fingers of the hand in between the side-opening panel and the top of the box to pry the box open. In addition to the associated discomfort. this method of opening the box eventually weakens either the top or the side-opening panel or both. In some cases a string-and-button type latch secures the side-opening panel. Alternatively, a metal or plastic turn-knob type latch is provided. Unfortunately, both of these latching mechanisms complicate construction and add to the cost of the box.

An additional disadvantage of prior art side-loading and top-loading boxes occurs when the box is constructed of material such as corrugated cardboard. For example, single-wall corrugated boxes require braces, sidewall stiffeners or other structural reinforcement to withstand the weight of multiple stacked loaded boxes. Such stiffeners are typically made from metal, wood, wire or plastic and provide the necessary mechanical strength to withstand heavy loads. For example, conventional side-loading boxes, loaded with 15 to 20 pounds of articles in each box, can be stacked two boxes high without bracing. Beyond that, either the boxes must be less heavily laden or sidewall stiffeners are necessary for at least the lowermost boxes in the stack.

A further disadvantage of prior art boxes of both types lies in the fact that they are often of multi-piece construction. Such boxes are often delivered in pallet loads requiring up to four separate pallets for the boxes, the lids, the stiffeners, and the inserts. The multiple pallet loads necessitate additional manufacturing, warehousing and transportation expenses.

Thus, there is a need in the art, for a side-loading box that can be easily opened and stacked without requiring stiffeners or braces.

SUMMARY OF THE INVENTION

The disadvantages of the prior art are overcome by the present invention of a single-piece side-loading box having triple side-wall construction and a unique latching tab.

The box incorporates walls, a floor, a top, a side-opening panel and latching tab in one unitary piece. In a preferred embodiment, the box is generally made from 250 lb. test corrugated board. The one piece box generally includes a bottom panel, front, side and back panels attached to the bottom panel and a lid attached to the back panel. A latching tab is incorporated into the front panel. The latching tab includes a handle to facilitate opening and closing the box. The front panel can also include side tabs to provide secure closure. The lid includes a lid flap and depending side reinforcements. The lid flap includes a slot sized to receive the latching tab. The side reinforcements fit inside the box adjacent the side walls. The side panels include side-walls, reinforcing side-wings and interlocking back reinforcements. The back reinforcements interlock in front of the back panel to provide additional strength at the back of the box. The side-wings fold back over the side reinforcements to provide additional strength for the side-walls. Tabs on the side-wings fit into cutouts at the juncture of the back reinforcements and the side-walls securing the side-wings and side reinforcements in place. The side-walls, side-wings and side reinforcements thus provide the box with a triple-side-wall construction allowing the box to support a great weight.

BRIEF DESCRIPTION OF THE DRAWINGS

FIG. 1(*c*) is a simplified side elevational view of the assembled box of FIG. 1(*a*);

FIG. 1(*d*) is a simplified bottom plan view of the assembled box of FIG. 1(*a*);

FIG. 1(*e*) is a simplified plan view of a cutout of an unassembled box of the type depicted in FIGS. 1(*a*)–1(*d*);

FIGS. 3(*b*)–3(*f*) depict different views of the insert of FIG. 3(*a*);

FIG. 3(*g*) depicts a simplified plan view of a cutout of an unassembled box insert of the type depicted in FIGS. 3(*a*)–3(*f*);

DESCRIPTION OF THE SPECIFIC EMBODIMENTS

Figure 1A:
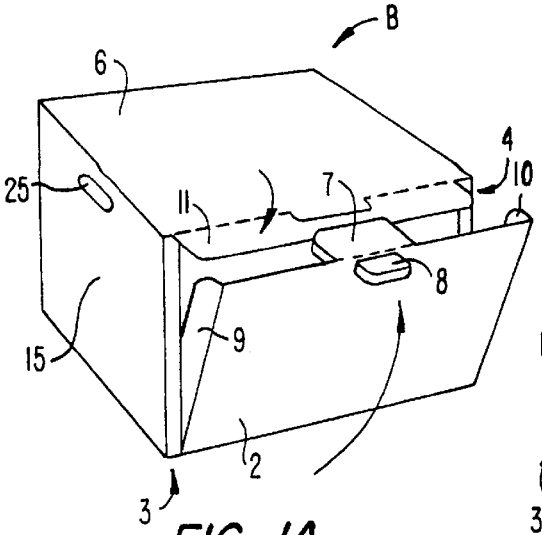
FIG. 1(a) is a simplified perspective view of an assembled box according to an embodiment of the present invention.
Figure 1B:
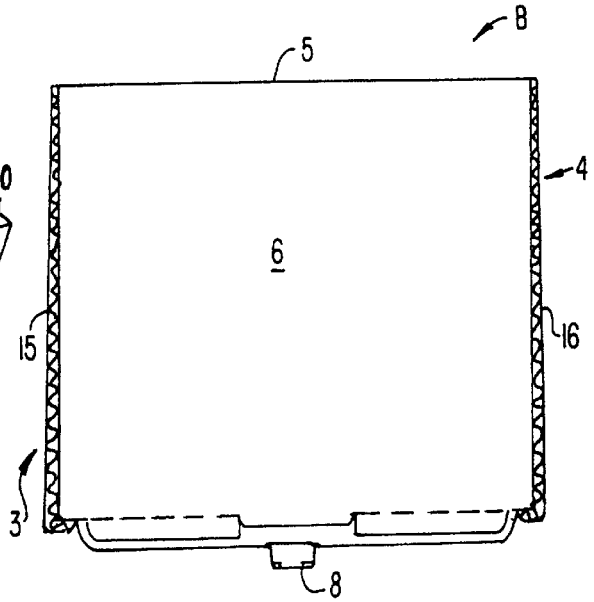
FIG. 1(*b*) is a simplified top plan view of the assembled box of FIG. 1(*a*)
Figure 1C:
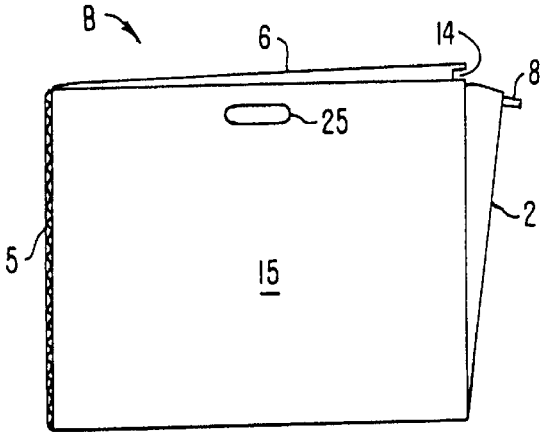
Figure 1D:
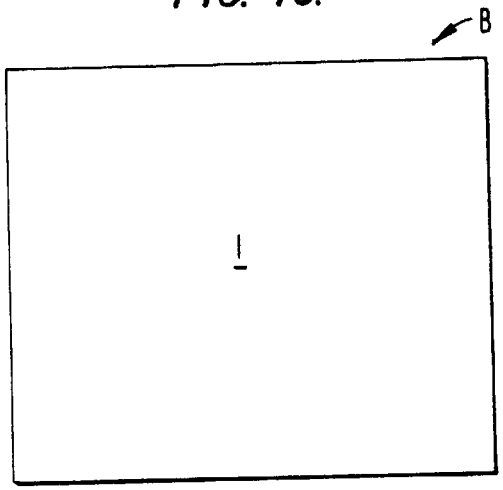
Figure 1E:
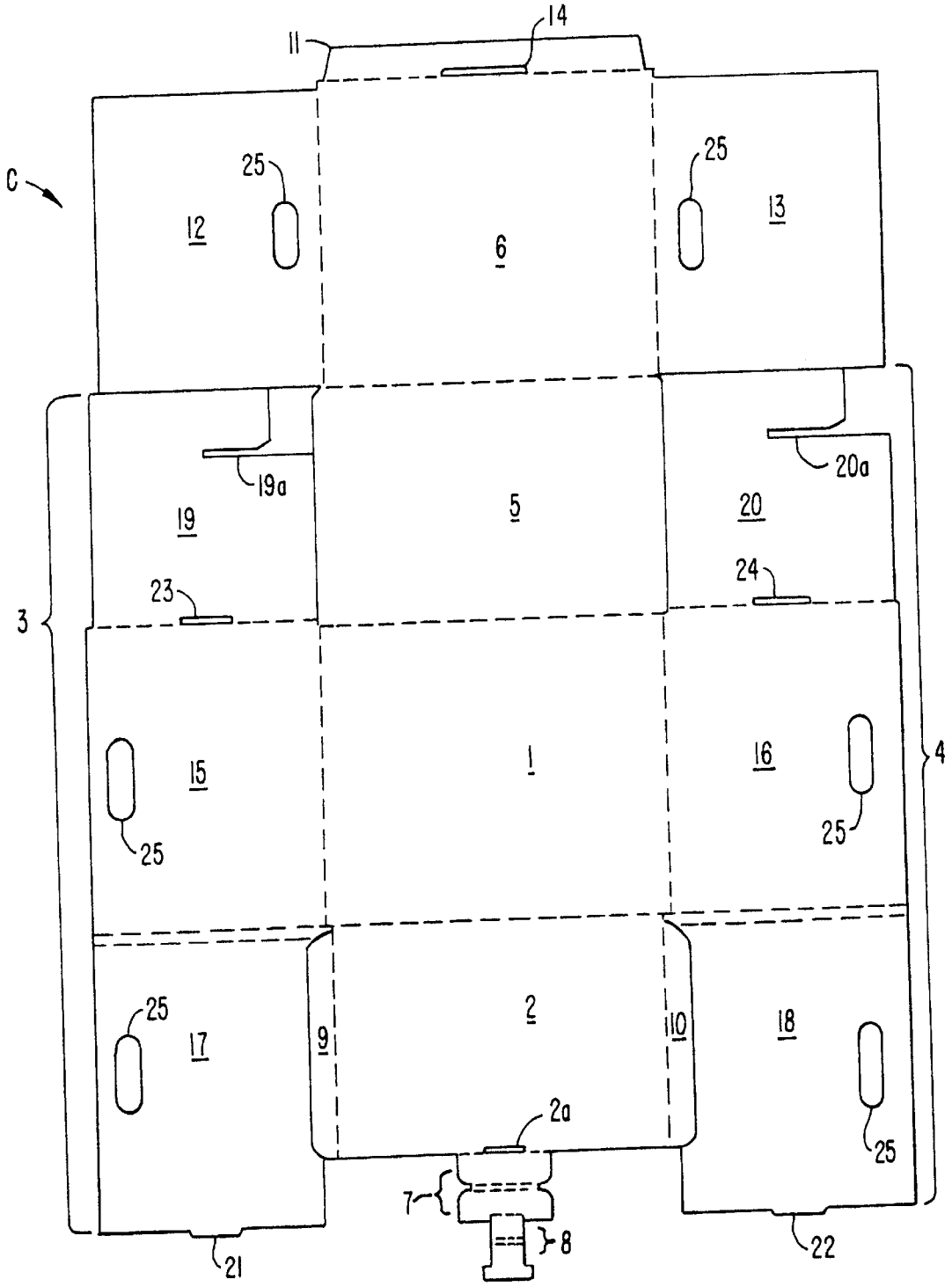
Figure 2A:
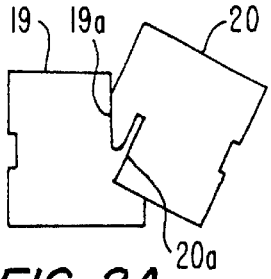
FIGS. 2(*a*)–2(*f*) depict the assembly of the box of FIGS. 1(*a*)–1(*e*)
Figure 2B:
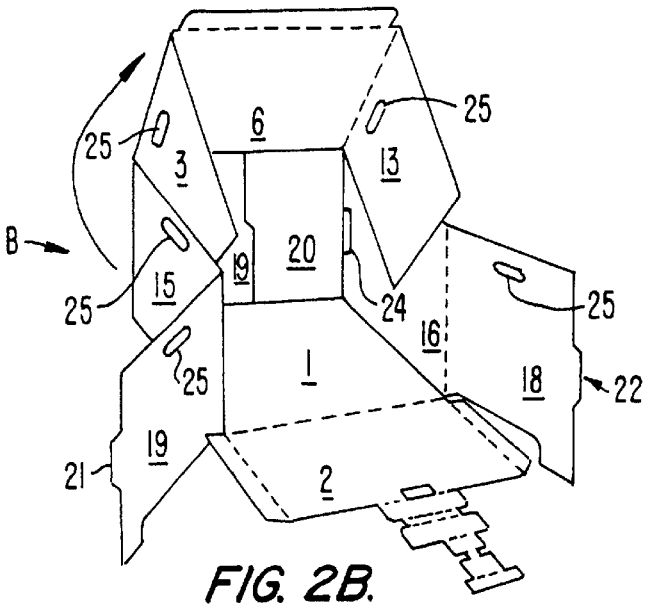
Figure 2D:
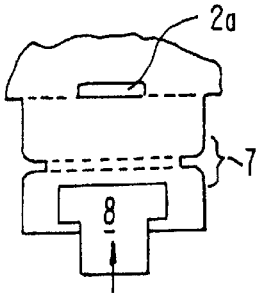
Figure 2E:
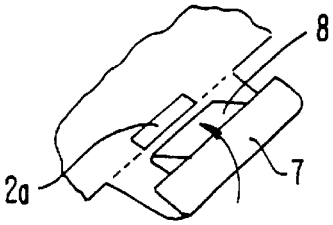
Figure 2C:
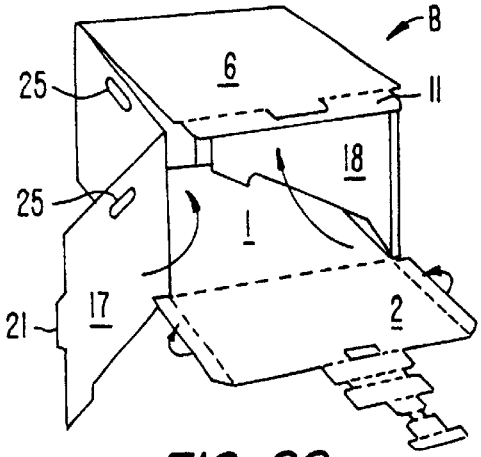
Figure 2F:
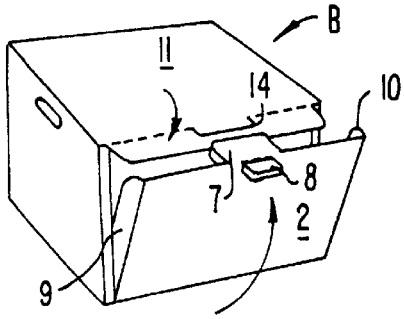
Figure 3E:
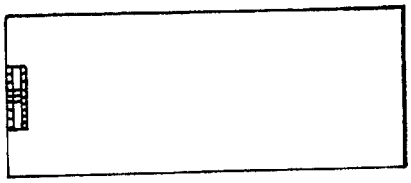
FIG. 3(*a*) is a simplified perspective view of an assembled box insert.
Figure 3F:
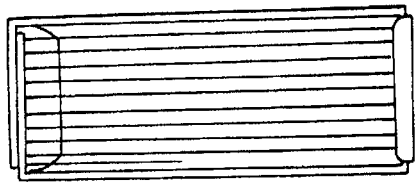
Figure 3D:
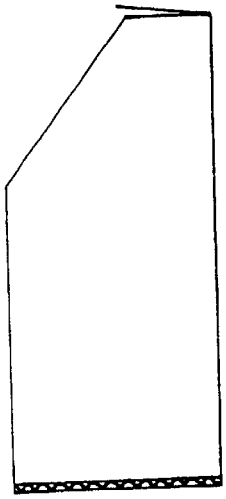
Figure 3C:
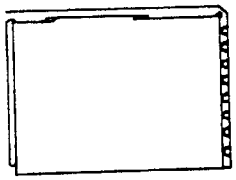
Figure 3A:
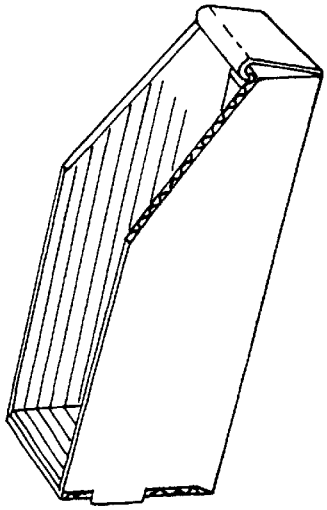
Figure 3B:
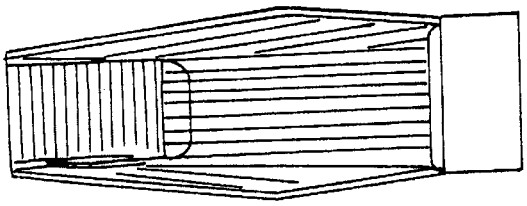
Figure 3G:
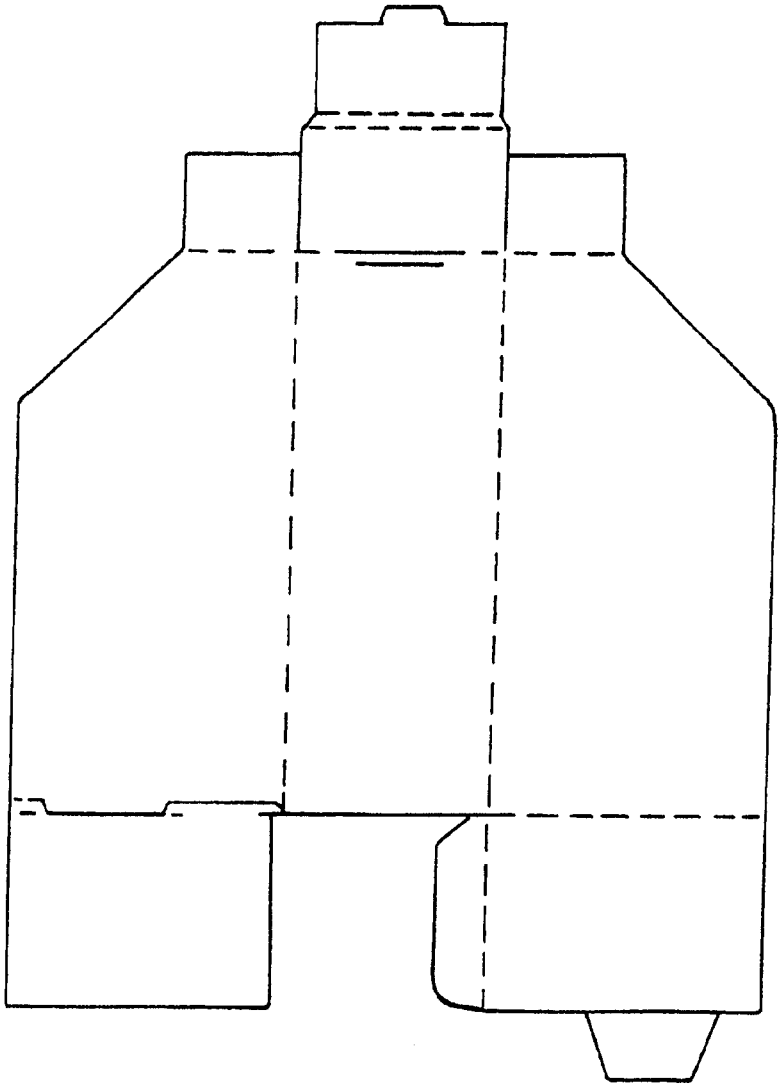
Figure 4A:
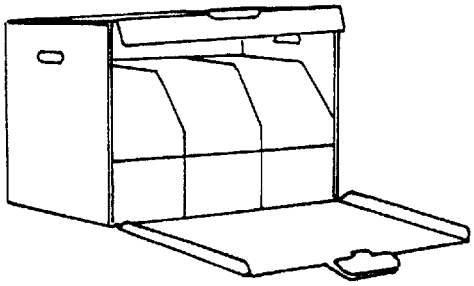
FIGS. 4(*a*)–4(*h*) depict simplified perspective views of boxes fitted with various inserts.
Figure 4B:
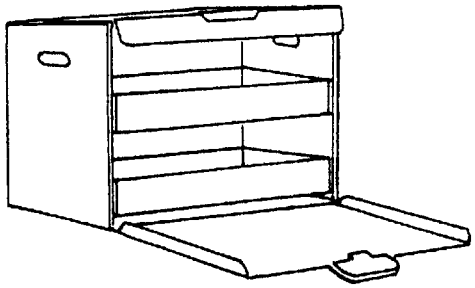
Figure 4C:
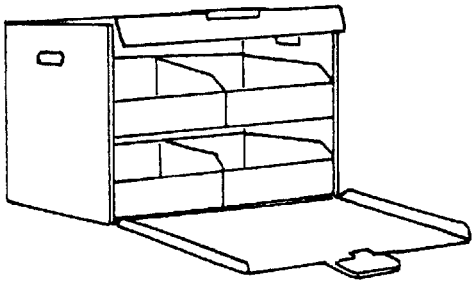
Figure 4D:
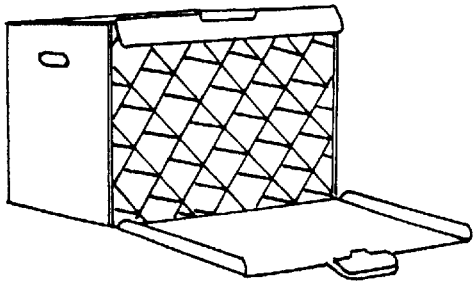
Figure 4E:
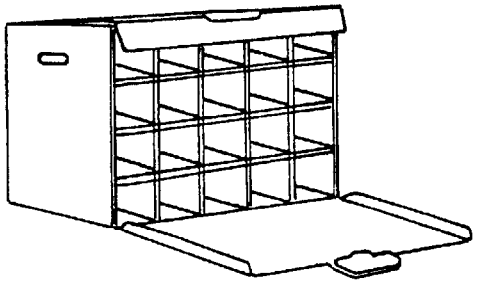
Figure 4F:
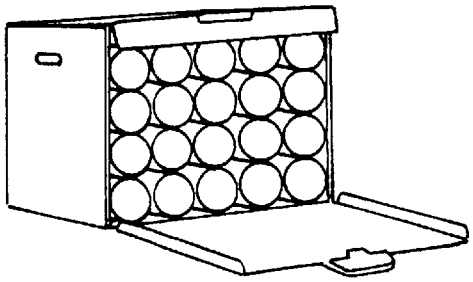
Figure 4G:
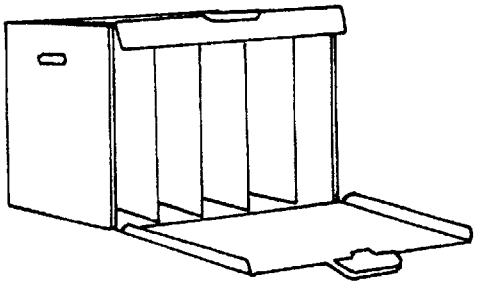
Figure 4H:
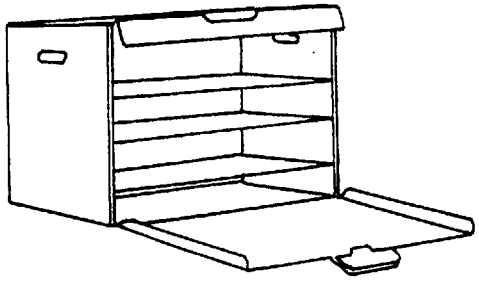

An embodiment of the side-loading box of the present invention is depicted in FIGS. 1(*a*)–1(*e*). The details of the assembled box B are apparent from FIGS. 1(*a*)–1(*d*). The one piece box B generally includes a bottom panel 1, a front panel 2, side panels 3 and 4 and a back panel 5. The front side and back panels are all attached to the bottom panel 1. A lid 6 is attached to the back panel 5. A latching tab 7 is incorporated into the front panel 2. The latching tab 7 includes a handle 8 to facilitate opening and closing the box. In the embodiment shown the front panel 2 includes side tabs 9 and 10 to provide secure closure. The lid includes a lid flap 11 and depending side reinforcements 12 and 13. The lid flap 11 includes a slot 14 that is sized to receive the latching tab 7. The side panels 3 and 4 include side-walls 15 and 16, reinforcing side-wings 17 and 18, and interlocking back reinforcements 19 and 20. The back reinforcements 19 and 20 interlock in front of the back panel 5 to provide additional strength at the back of the box B.

The side reinforcements 12 and 13 fit depending from lid 6 inside the box B adjacent the side walls 15 and 16. The side-wings 17 and 18 fold back over the side reinforcements 15 and 16 to provide additional strength for the sides of the box B. Tabs 21 and 22 on the side-wings 17 and 18 fit into slots 23 and 24 at the juncture of the back reinforcements 19 and 20 and the side-walls 15 and 16 securing the side-wings 17 and 18 and side reinforcements 12 and 13 in place. The side-walls 15 and 16, side wings 17 and 18 and side reinforcements 12 and 13 thus provide the box with a triple-side-wall construction allowing the box to support a great weight. Side-walls 15 and 16, side reinforcements 12 and 13, and side wings 17 and 18 include cutouts 25 that align when the box is assembled to form convenient handholds. Material can be completely removed from box to form cutouts 25 defined by voids or aperture through the material of the box. Alternatively, one or more cutouts 25 may be formed such that the cut material defines a flap that folds inwards or outwards to allow closure of the void.

Although a box having triple-side-wall construction is disclosed herein, those skilled in the art will be able to find other methods of providing a side-wall of a box with two or more reinforcements to provide multiple-side-wall construction.

In a preferred embodiment, the box is cut from a single flat piece of material. FIG. 1(*e*) depicts the layout of a cutout C of single flat piece of material, prior to assembly. Generally cutout C is cut along the solid lines in FIG. 1(*e*) and folded along the dashed lines to form the box B depicted in FIGS. 1(*a*)–1(*d*). FIGS. 2(*a*)–2(*f*) depict the steps of assembling the cut piece of board of FIG. 1(*e*) into the assembled box B. First, and side-walls 15 and 16 are brought up and back reinforcements 19 and 20 are folded over each other and hooked together so that slots 19*a*, 20*a* interlock as shown in FIG. 2(*a*). Next, lid 6 is brought up and depending side reinforcements 12 and 13 are placed inside the box as shown in FIG. 2(*b*). Then side wings 17 and 18 are folded over side reinforcements 12 and 13 and tabs 21 and 22 locked into slots 23 and 24 as shown in FIG. 2(*c*). Next handle 8 is folded over latching tab 7 as shown in FIG. 2(*d*) and handle 8 is inserted into slot 2*a* in front panel 2 as shown in FIG. 2(*e*). To close the box, lid flap 11 is folded down, front panel 2 is lifted up side tabs 9 and 10 are folded in and latching tab 7 is inserted into slot 14 as shown in FIG. 2(*f*).

In a more preferred embodiment. the box is generally made from corrugated board such as cardboard. Such a material is typically cut into shape using conventional means such as rotary die cutters. In a most preferred embodiment, the box is made from 250 lb. test corrugated board. Although the box is described herein as being made of corrugated board. Those skilled in the art will recognize that any suitable material used in container-making can be used. Such materials include but are not limited to plastic, metal, wood, rubber, corrugated plastic, wire and laminated or composite materials incorporating any or all of these.

Boxes constructed in accordance with the above embodiment can be fitted with various inserts to partition the box for storing different types of articles. Such inserts provide for convenient filing of and a access to a diverse range of articles such as documents and business materials. FIGS. 3(*a*)–3(*g*) depict various views of one such type of insert. In particular, FIG. 3(*g*) depicts the layout of such an insert on a single piece of corrugated board after cutting and prior to assembly. The insert shown is an example of an embodiment of a removable vertical organizer insert. Other inserts may be used with embodiments of the box of the present invention. Such inserts include tray organizer inserts, diagonal organizer inserts, cube organizer inserts, tube organizer inserts, vertical partition inserts and horizontal partition inserts. Examples of boxes equipped with such inserts are depicted in FIGS. 4(*a*)–4(*h*).

Figure 5:
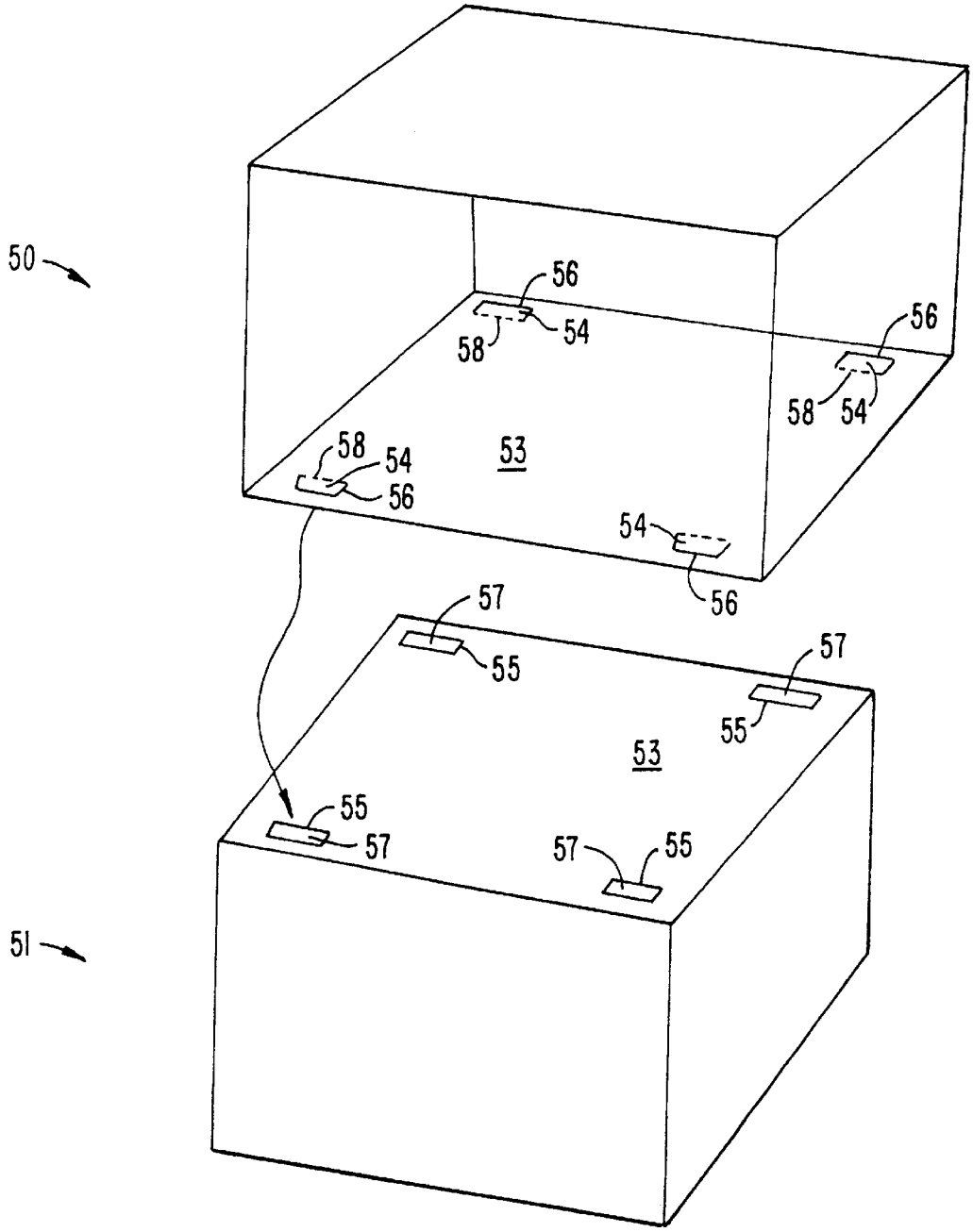
FIG. 5 depicts a simplified perspective view of two boxes configured to prevent them from moving when stacked according to an alternative embodiment of the present invention.

Side-opening containers of the type depicted herein can be configured to prevent them from moving when they are stacked. FIG. 5 depicts two boxes, e.g., of the type described above, that have been suitably configured to interlock when stacked. An upper box 50 has a bottom side 52 that includes one or more tabs 54 (four are shown) defined by perforations formed along solid lines 56. Tabs 54 fold outward (i.e., downward) along dashed lines 58 to protrude from bottom 52 of box 50. A lower box 51 includes one or more slots 55 (four are shown) in a top side 53. Slots 55 are sized and located to receive tabs 54 protruding from the bottom side 52 of upper box 50. Tabs 54 engage slots 55 to prevent motion of top box 50 and bottom box 51 relative to each other. Such slots can be made by perforating top side 53 so that cutouts 57 can be punched out if desired. Slots 55 can, alternatively, be perforated to allow cutouts 57 to fold inward, i.e., downward. Of course, boxes could be configured for stacking in stacks of 3 boxes high or higher, by including both tabs and slots in the layout of the cutout from which the box is formed.

While the above is a complete description of the preferred embodiment of the present invention. it is possible to use various alternatives, modifications and equivalents. Therefore. the scope of the present invention should be determined not with reference to the above description but should, instead, be determined with reference to the appended claims, along with their full scope of equivalents.

What is claimed is:

1. A single-piece side-loading box, comprising:

a floor comprising a bottom panel;

two or more walls comprising two side panels and a back panel, said side and back panels being attached to said bottom panel;

a top comprising a lid attached to said back panel; and a side-opening panel having a latching tab with a handle and comprising a front panel attached to said bottom panel;

wherein said floor, walls, top, side-opening panel and latching tab and handle are fabricated in a unitary piece.

2. The side-loading box of claim 1 having a multiple-side-wall construction.

3. The side-loading box of claim 2 wherein said multiple-side-wall construction is a triple-side-wall construction.

4. The side-loading box of claim 1 wherein said lid includes a lid flap and depending side reinforcements.

5. The side loading box of claim 4 wherein said lid flap includes a slot sized to receive said latching tab.

6. The side-loading box of claim 4 wherein said side reinforcements are configured to fit inside the box adjacent the side walls.

7. The side-loading box of claim 6 wherein said side panels include side-walls, two or more reinforcing side-wings and two or more interlocking back reinforcements.

8. The side-loading box of claim 7 wherein said side-wings fold back over the side reinforcements.

9. The side-loading box of claim 8 wherein said side walls, said side wings and said side reinforcements contain cutouts, said cutouts being configured to align with each other.

10. The side-loading box of claim 1 wherein said box is made of corrugated board.

11. The side-loading box of claim 10 wherein said corrugated board is 250 pound test corrugated cardboard.

12. The box of claim 1 further comprising one or more inserts for organizing articles stored within the box.

13. The side loading storage box of claim 1 wherein said floor includes one or more tabs configured to protrude from said floor.

14. The side loading storage box of claim 1 wherein said top includes one or more slots.

15. A single-piece side-loading box, comprising:

a bottom panel;

two side panels attached to said bottom panel;

a back panel attached to said bottom panel;

lid attached to said back panel; and a side opening front panel attached to said bottom panel;

wherein said floor, walls, top, side-opening panel, are fabricated in a unitary piece of corrugated board that provide multiple-side-wall construction, and wherein said side panels include side-walls, two or more reinforcing side-wings and two or more interlocking back reinforcements.

16. A single-piece cutout for a container comprising a bottom panel portion;

two side panel portions attached to said bottom panel portion;

a back panel portion attached to said bottom panel portion;

lid portion attached to said back panel portion; and a side opening front panel portion attached to said bottom panel portion;

wherein said side panel portions include side-walls, two or more reinforcing side-wings and two interlocking back reinforcements.

17. A method of making a box comprising:

providing a sheet of material; and cutting said sheet into a shape that defines a bottom panel portion, two side panel portions attached to said bottom panel portion, a back panel portion, attached to said bottom panel portion, lid portion attached to said back panel portion; and a side opening front panel portion attached to said bottom panel;

wherein said front panel portion includes a latching tab having a handle.

18. A method of making a box comprising:

providing a sheet of material; and cutting said sheet into a shape that defines a bottom panel portion, two side panel portions attached to said bottom panel portion, a back panel portion attached to said bottom panel portion, lid portion attached to said back panel portion; and a side opening front panel portion attached to said bottom panel;

wherein said side panel portions include two or more side-wall portions, two reinforcing side-wing portions and two interlocking back reinforcement portions and said lid portion includes two side reinforcement portions.

19. The method of claim 18 further comprising:

folding said back reinforcement portions over each other and interlocking them;

bringing said side panel portions up to form sides of the box;

placing said depending side reinforcements inside the box; and folding said side wings over said side reinforcements.

* * * * *